US008931716B2

(12) United States Patent
DeFlorian et al.

(10) Patent No.: US 8,931,716 B2
(45) Date of Patent: Jan. 13, 2015

(54) SPRAY PUMP DEVICE

(75) Inventors: Stefano DeFlorian, Trento (IT); Julio César Ruiz Ballesteros, Cerdanyola del Valles (ES); Walter Sordo, Trento (IT); Daniel Mosconi, Trento (IT)

(73) Assignee: Zobele Holding SpA, Trento (IT)

( * ) Notice: Subject to any disclaimer, the term of this patent is extended or adjusted under 35 U.S.C. 154(b) by 638 days.

(21) Appl. No.: 12/253,445

(22) Filed: Oct. 17, 2008

(65) Prior Publication Data

US 2009/0121041 A1 May 14, 2009

Related U.S. Application Data

(60) Provisional application No. 60/980,825, filed on Oct. 18, 2007.

(51) Int. Cl.
*B05B 9/043* (2006.01)
*B05B 11/00* (2006.01)

(52) U.S. Cl.
CPC ..... *B05B 11/3052* (2013.01)
USPC ..... 239/333; 239/67; 239/69; 239/71; 239/73; 239/75; 239/332; 239/337; 239/575; 222/333; 222/187; 401/196

(58) Field of Classification Search
USPC ..... 239/13, 67–74, 332, 333, 75, 145, 337, 239/575; 222/52, 54, 333, 187; 401/23, 196
See application file for complete search history.

(56) References Cited

U.S. PATENT DOCUMENTS

| | | | | |
|---|---|---|---|---|
| 4,245,967 | A | 1/1981 | Busselet | |
| 4,790,624 | A * | 12/1988 | Van Hoye et al. | 385/118 |
| 6,065,934 | A * | 5/2000 | Jacot et al. | 416/155 |
| 6,916,159 | B2 * | 7/2005 | Rush et al. | 417/321 |
| 7,252,211 | B2 | 8/2007 | Bougamont | |
| 7,422,595 | B2 * | 9/2008 | Morris et al. | 606/200 |
| 7,617,703 | B2 * | 11/2009 | Osvatic | 68/12.26 |
| 7,628,554 | B2 * | 12/2009 | Wernersson | 396/463 |
| 2003/0198558 | A1 * | 10/2003 | Nason et al. | 417/53 |
| 2008/0083368 | A1 * | 4/2008 | Ward | 401/196 |

FOREIGN PATENT DOCUMENTS

| | | | |
|---|---|---|---|
| JP | 63-28155 | U | 2/1988 |
| JP | 2001123938 | A | 5/2001 |
| JP | 2004185059 | A | 7/2004 |

OTHER PUBLICATIONS

Japanese Office Action corresponding to Japanese patent appln. No. 2010-529395 dated May 31, 2013 (6 pages).

* cited by examiner

*Primary Examiner* — Steven J Ganey
(74) *Attorney, Agent, or Firm* — McCormick, Paulding & Huber LLP

(57) ABSTRACT

The invention refers to a spray pump device for spraying a liquid operated by a memory shape element. The spraying device is provided with a memory shape alloy wire with electrical resistivity, that is able to generate heat that increases its temperature so that due to memory shape property, the wire shrinks when current is applied. This shrinking permits the wire to activate a pump that atomizes a volatile substance.

12 Claims, 8 Drawing Sheets

SPRAY PUMP DEVICE

CROSS REFERENCE TO RELATED APPLICATIONS

This application claims the benefit of and incorporates by reference essential subject matter disclosed in U.S. Provisional Patent Application No. 60/980,825 filed on Oct. 18, 2007.

TECHNICAL FIELD

The present invention relates to spray pump devices.

BACKGROUND OF THE INVENTION

Pump atomizers for spraying a dose of a liquid are very well known on the state of the art. The U.S. Pat. Nos. 4,245,967 and 7,252,211 describe examples of conventional hand-actuated spraying devices.

BRIEF DESCRIPTION OF THE INVENTION

One aspect of the invention refers to spraying devices for spraying a liquid operated by a memory shape element. The spraying device is provided with a memory shape alloy wire with electrical resistivity, that is able to generate heat that increases its temperature so that due to memory shape property, the wire shrinks when current is applied. This shrinking permits the wire to activate a pump that atomizes a volatile substance.

The device of the invention comprises a container with a pump spray head that is activated by a wire with memory shape, for example a Ni—Ti wire. This wire is able to generate by itself due to the electric current passing through it, the heat that will activate its mechanical property.

The Ni Ti wire when conducting a pulse current generated by an electronic circuit shortens and exerts a force that moves a lever that in turn activate the pump. The pump drops a metered amount of liquid (a fragrance for instance) on a porous element or a mat.

The spraying device comprises a spray head and a porous material arranged to receive a major amount of the liquid sprayed by said pump head. Preferably, the porous material is in direct contact with the spray head to avoid any leakage of liquid. But also it could exist some air gap between the spray head and the porous part.

A volatile substance is then evaporated passively or due to the action of an air flow in the atmosphere from the porous head.

In addition, the activation of the pump is controlled by electronics. A timer controls the activation of the pump head so that a dose of liquid is sprayed into the porous material at selected intervals of time. The timer controls that dosification does not occurs too often, and thus avoid possible saturation of the porous element that would possibly lead to leakage.

PREFERRED EMBODIMENT OF THE INVENTION

Figure 1:
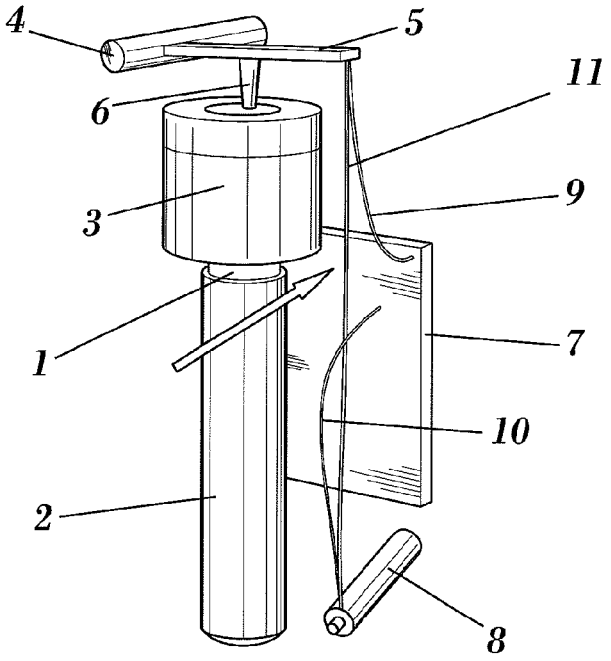
FIG. 1 shows a perspective view of a preferred embodiment of the invention.
Figure 3:
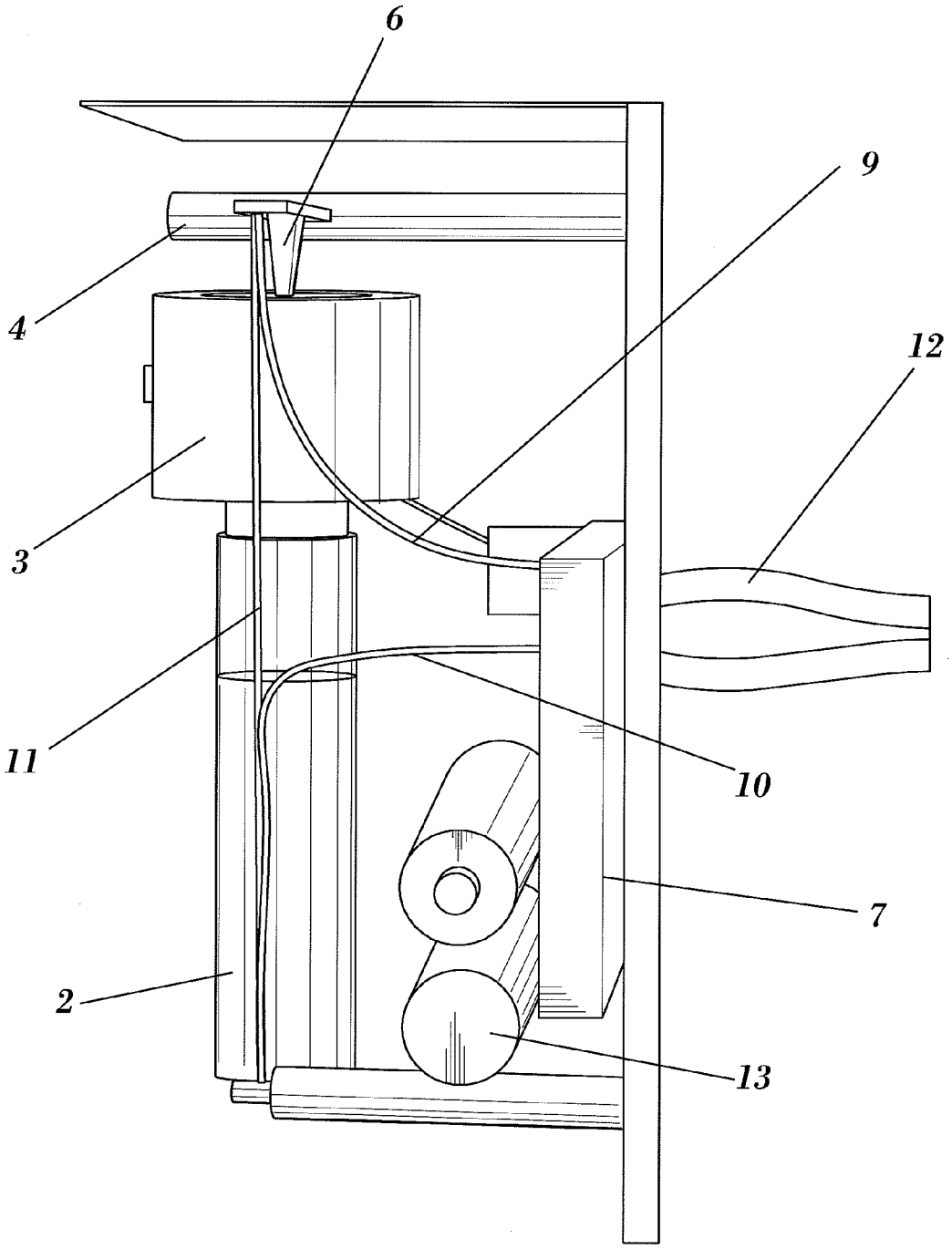
FIG. 3 shows a side view of the same device of FIG. 1.

As shown in FIGS. 1 and 3, the spray pump device of the invention comprises a spray head (1) operated by a memory shape wire (11).

The device comprises a lever (5) pivotally mounted at one of its ends to a fixed element (4) of the device, that is joined to the casing (30) of the device. An extension (6) of the lever can contact with the upper surface of the pump head (1) so as to push down the head when the wire shrinks.

A first end of the wire (11) is joined to a point of said lever (5), and a second point of the wire (11) is joined to a second fixed point (8) of the device.

A container (2) containing a liquid is conventionally coupled to the pump spray head (3). Alternatively, a pressurized container or any kind of spraying valve known in the state of the art and activable by an axial movement, can be used as well.

To spray an amount of said liquid, an electric current is applied to the wire (11) by means of power supply wires (9,10). Said current is controlled by means of an electronic circuit (7), and its value is selected so as to heat the wire and cause its shrinking.

When the wire heats up its length is reduced due to its memory shape property, and the lever rotates applying at the same time a force (F) against the pump head to activate it, so that an amount of liquid is sprayed out through the opening (18) of the pump head.

Figure 2:
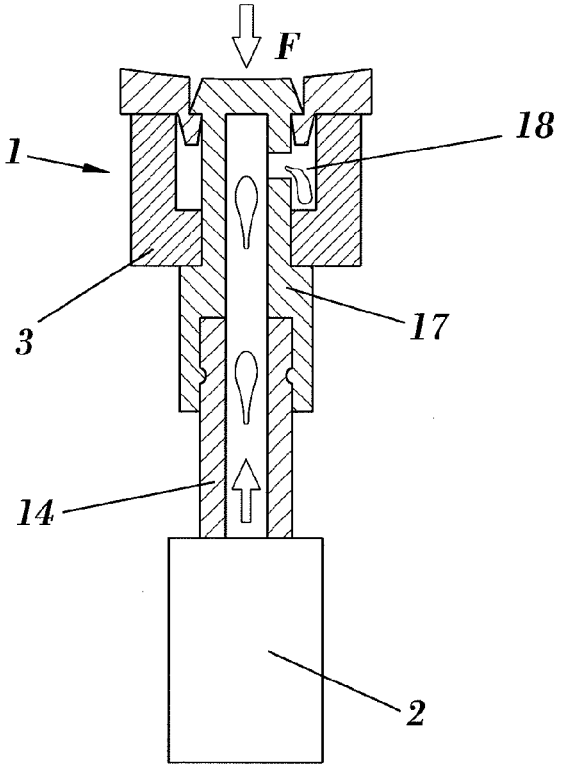
FIG. 2 shows a cross sectional view of a spray pump device. The operating force (F) to activate the pump has been represented by an arrow. The reference numeral (14) indicates a part of the valve of a liquid container (2).

Preferably, a porous material (3) in the form of a tubular sleeve is fitted to the pump head (1), so as to receive a major amount of the liquid sprayed by said pump head. As shown in FIG. 2, the pump head (1) includes a tubular member (17) having an outlet (18) coupled to the valve of a conventional container (2), for example containing a perfume.

The device can have a clip (12) to be mounted on the vent grid of a car dashboard, and batteries (13) to supply an electric current to the wire.

The device of the invention may require a small activation force (F) to activate the pump. Standard pumps normally work from 1 to 2 Kg. The pump spray of the invention works around 0.5 Kg.

The reason for this is that the activation has to be done around 0.5 to 1 Sec.

A wire activate (has the transition) in around 1 sec. and short for about 3 to 5%. Considering a wire longer not more than 100 mm, for 0.250 mm gauge we can develop a force of 1 Kg and a length of around 4 mm.

3-4 mm is the run of the pump valve (14).

Force (F) can also be increased by installing a second wire in parallel.

By using two wires connected in parallel, it is possible to activate the selected pump at 0.5 Kg with 4 mm run in 0.5 sec with a 0.250 mm wire.

Alternatively, force can be increased by increasing the wire thickness.

Movement distance/or movement speed can be increased using a lever.

Alternatively, movement distance or movement speed can be increased by increasing the current flow in the wire to reduce the time needed to reach the transition temperature. In such case, care shall be taken to reduce the possibility to overstress the wire.

Different mechanical configurations are possible to adapt the wire deformation kinetics to the requirement of the pump spray head.

In a preferred embodiment of the invention, the device is configured to operate with a wire shorter than 60 mm. The device is operated by a battery, for example providing a 3.5V voltage, and the total nominal battery energy load lower than 3000 mA HR. The number of possible activation with that energy is at least 1000 pump strokes.

Figure 4C:
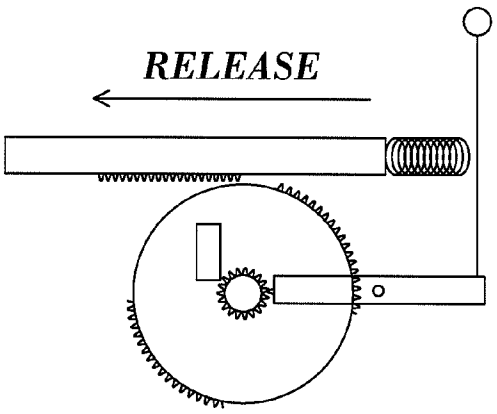
FIG. 4 schematically shows a mechanism used in combination with a memory wire to store the energy generated by the wire. The figure shows a sequence of the operation of said mechanism.
Figure 4B:
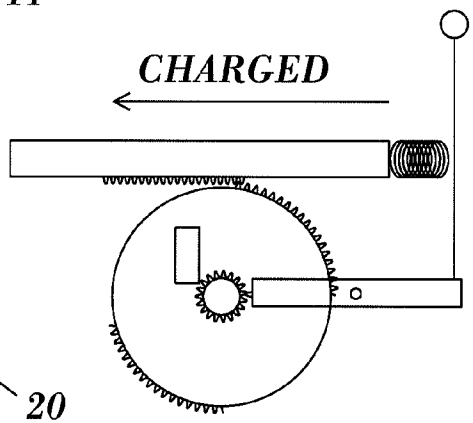
Figure 4A:
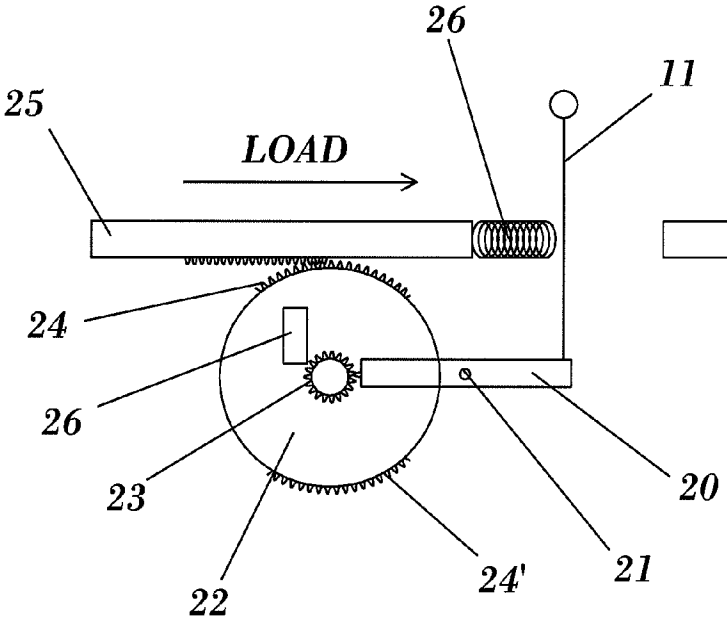
Figure 5:
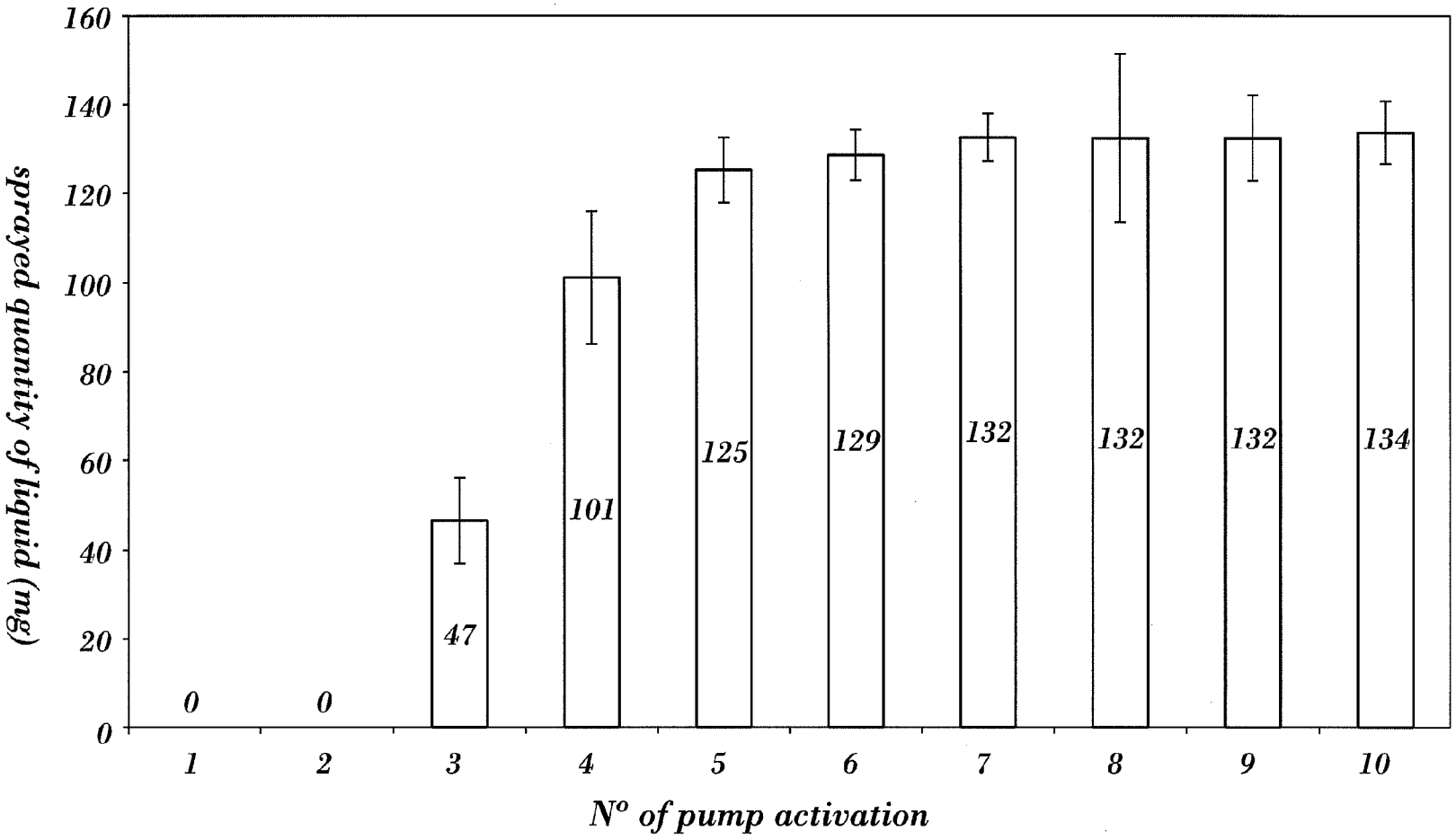
FIG. 5 is a graphic showing the amount of liquid in miligrams (mg) sprayed in each consecutive activation of the pump. In the first two activations, the pump contains no liquid. The pump is charged progressively with liquid during the 3rd, 4rd and 5th activations.
Figure 6:
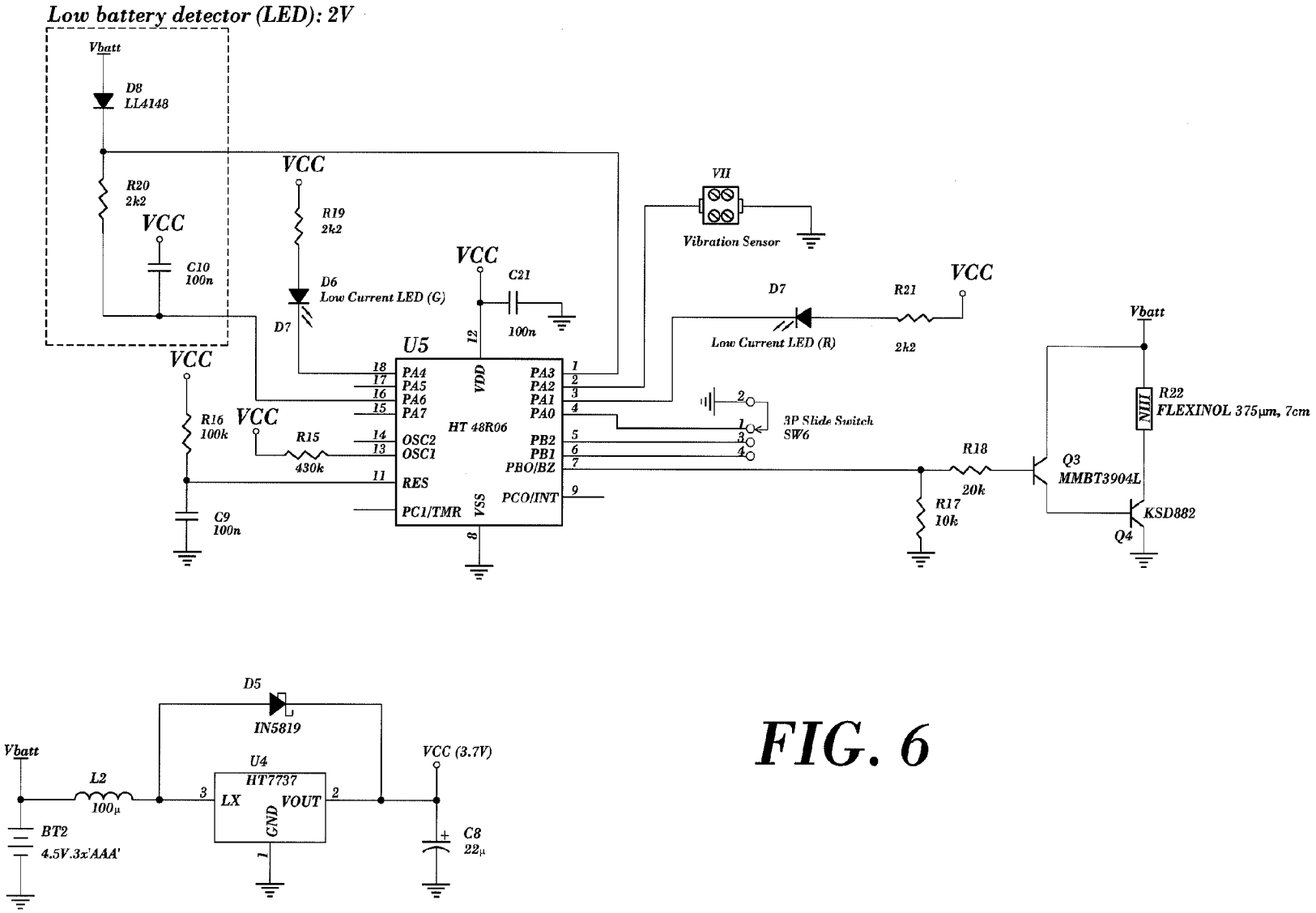
FIG. 6 is a practical example of an electronic circuit used to control the device without ambient temperature detection.
Figure 7:
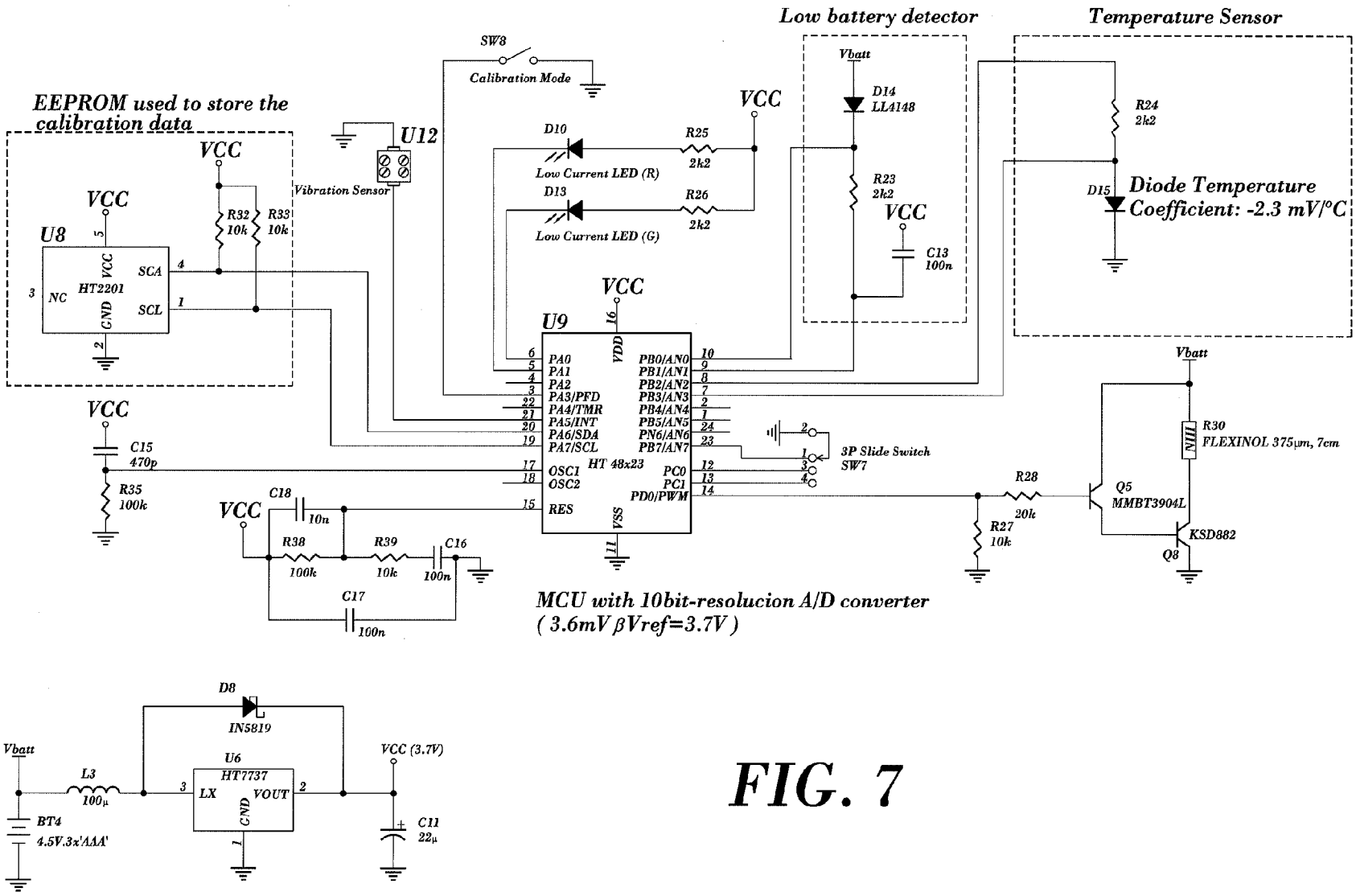
FIG. 7 is a practical example of an electronic circuit used to control the device using ambient temperature detection.

FIG. 4 shows an exemplary embodiment of the invention in which the memory wire (11) is used in combination with a mechanism to store the energy generated by the wire in several shrinking actions of the wire. One end of the wire (11) is connected to a lever (20) which can pivot about a point (21). A second end of this lever (20) is engaged with a first toothed wheel (23) located at the center of a second wheel (22) having outer toothed sections (24') diametrically located as shown in FIG. 4. The second wheel (22) is engaged with a rod (25) so that rotation of the wheel causes the displacement of said rod (25) during a load action illustrated in FIG. 4(*a*). A spring (26) is arranged in such a manner that it is progressively compressed by the rod (25) as the rod is displaced.

The second wheel can only rotate in one direction due to a stopper element (26), thus keeping the rod in a fixed position against the spring (26). When the toothed section (24) disengage with the rod, as shown in FIG. 4(*b*), the rod is free to move and the energy stored in the compressed spring (26) is released displacing thereby the rod as shown in FIG. 4(*c*).

Displacement of the rod is used to activate a pump spray head of a liquid container to spray a certain amount of liquid.

The above-described mechanism is configured to store just enough energy in the spring to activate a pump spray head.

The correct working of the device at its first activation, can be garantized in two ways:

1) in its production process by pre-filling the valve whit first two sprays (pump spray need to be prefilled before first use), 2) electronically: a switch detects the first insertion of the refill.

If the device is in an environment with a temperature over the wire transition, the ambient temperature can cause the wire to shrinks. A spray is release but as the wire remains in its shrunk state, no more spray are released. In addition, the presence of a hysteresis on the wire assure that the system will not oscillate around the transition temperature, and avoid thus multiple activation of the spray when ambient temperature is fluctuating around the transition temperature.

The device can be provided with electronics means in order to prevent the accidental activation of the pump when the ambient temperature is over the wire transition temperature.

Typical transition temperature is between 70° C. and 90° C.

In case the application require the device to perform differently over or under a certain temperature close to the transition temperature on the memory wire, a circuit to detect that temperature can be added to the electronic circuit (7).

Figure 8:
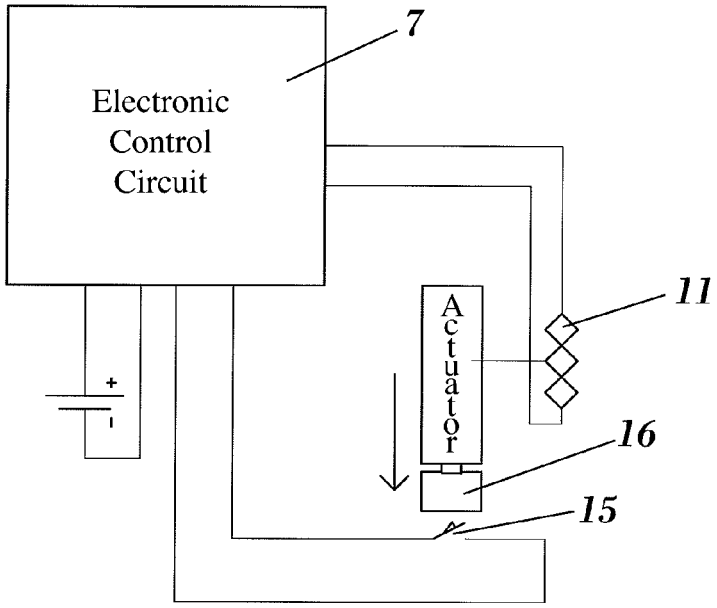
FIG. 8 is a schematic diagram of an example with end run switch to detect actuator movement.
Figure 9:
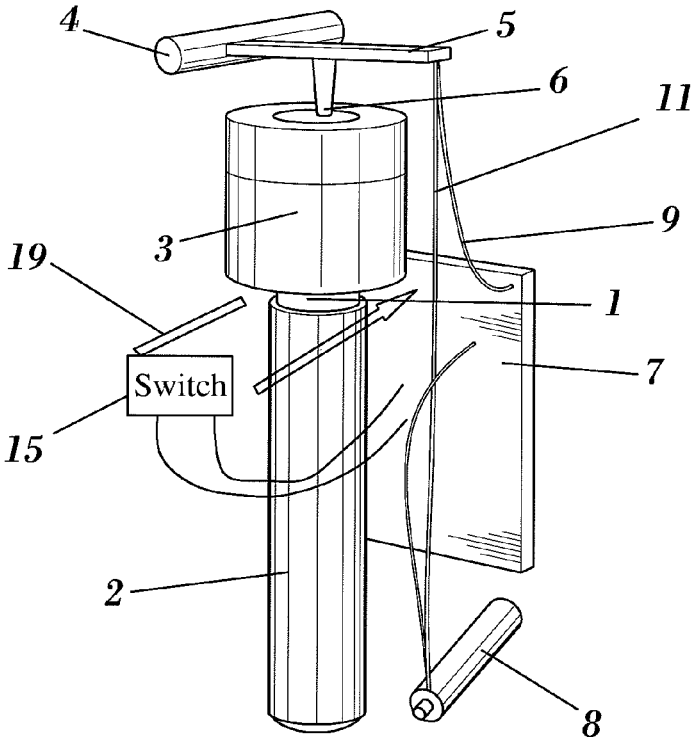
FIG. 9 is a perspective view similar to FIG. 1 including an end-run switch.

FIGS. 8 and 9 are two examples of the electronic circuit used to control the application without (FIG. 8) and with (FIG. 9) the detection of temperature.

In the case of FIG. 9 the circuit make use of a diode forward voltage behaviour with the temperature and a analog-to-digital (ADC) converter (or a voltage comparator as alternate solution) to detect the temperature in which the device is working.

The second circuit provide capability of recording the tuning setting of the temperature that can be done autonomously by the device during the manufacturing phase in a "configuration mode setting". If the device is set in this configuration mode inside a preset temperature environment, during manufacturing, the device will have the possibility to auto acquire and self programming the temperature tuning setting.

In another preferred embodiment, the device is controlled by sensor (not shown) such as: a movement sensor, a light sensor or a proximity sensor, said sensor being associated to the electronic circuit (7). In the case of a movement sensor, any prior art device which is suitable for detecting movement or vibration can be used, so that the dosing of the liquid containing an active ingredient can be done only if a particular movement or vibration is detected.

The movement sensor may be used in a car and to make sure that the device will work only when the car is moving.

In such a case the following algorithm can be implemented:

When the device is switched on, the device is placed in a "wait for movement condition".

In case of a no-movement situation, the dosing never happens or if necessary it will happen only with a cycle timing (Said Z minutes) to guarantee a minimum presence of the active ingredient in the air.

In the case that a movement is detected, the device will perform at least one dosing. After that, it remains in stand by to wait for a next movement. If at least one movement is detected within a X and Y minutes the device at the end of the Y time will again perform one or more dosing. If within X and Y minutes it does not detect any movement, the device will be place again in a "waiting for movement condition" which is the same state entered after switching on.

Figure 10A:
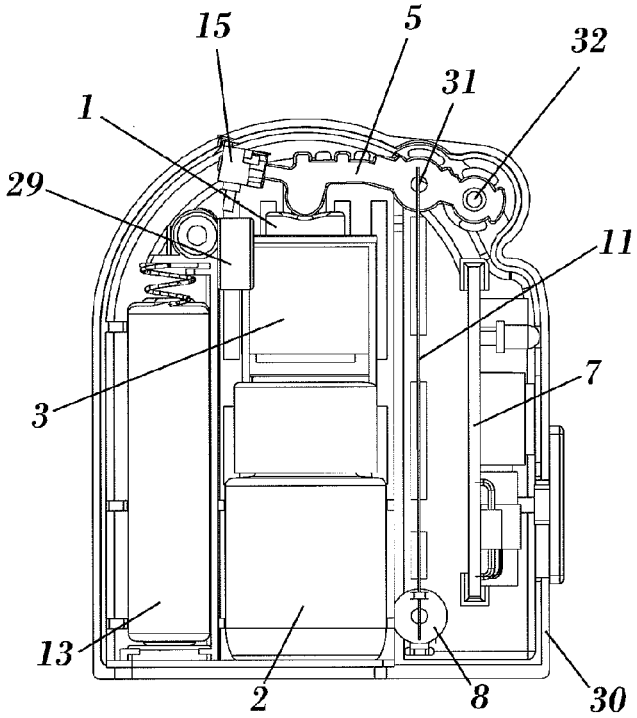
FIG. 10 shows a practical implementation of a device according to the invention using an end-run-switch, and with the front cover of the casing removed for illustration purposes. Figure (a) is a front elevational view of the device, figure (b) is a side view, and figure (c) is a top view.
Figure 10B:
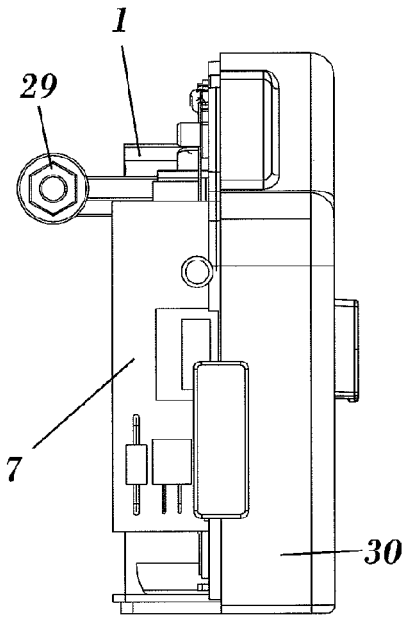
Figure 10C:
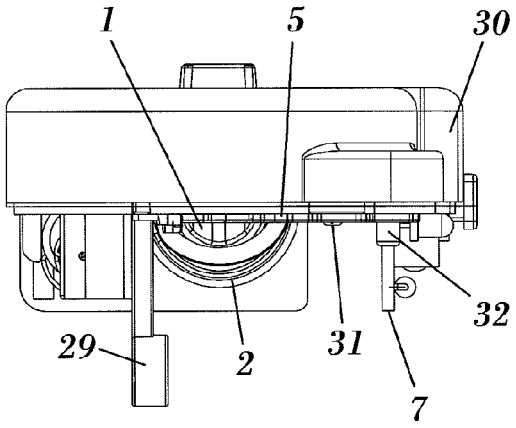

As shown in FIGS. 10 and 11, an end-run-switch (15) can be used to signal to the electronic circuit (7) that the movement of the actuator (16) has been completed, that is the actuator (16) has reached a position in which the spray head has been activated.

More in detail and in view of FIG. 10, the electronic circuit (7) supply a current to the memory wire (11) which causes this wire to shrink. Shrinking of the wire (11) causes the movement of an actuator (16) (for example as shown in FIG. 11), which in turn exerts a force against the spray pump head (not shown in FIG. 10) to spray an amount of liquid.

The end-run-switch (15) is connected to the electronic circuit (7), and it is arranged to detect to end position of the spray head in which an spray action is obtained. FIG. 11 shows a position of the end-run-switch (15) in respect to the spray head. The lever (19) of the end-run-switch (15) will be pressed down by the spray head at the end of a spraying action.

The use of an end-run-switch (15) will allow the following:

1) since the heating current flowing in the wire is proportional to the voltage applied to the wire and the temperature that the wire will reach depend also from the amount of time this current is applied, in case of a battery operated application the voltage over time will decrease so will do of course the current (since the resistance of the wire is constant);
2) In case the current application time is fixed there will be a moment where the energy provided to the wire will not be enough to shrink completely the wire as the power will not be applied longer enough to achieve the temperature of transition and maintain it enough to complete it.
3) This at the end give a limitation to the amount of energy usable from the battery.
4) In case the movement (so the complete transition of the wire) is achieved not waiting some defined time, but verifying it using the activation of an electrical contact (provided by a end-run-switch (15)). In this case the current (independently of the voltage) will be always applied longer enough to complete the shrinking at the transition temperature. In this case the limitation of the usable energy of the battery achieved in the first cases is overcame as the system will provide the available power at that moment (proportional to the voltage) always longer enough to complete the movement.
5) The only limitation in this case is the timing that will be necessary to reach the temperature of transition or the lack of power to heat up the wire (independently from how long the application of the power will be done)
6) The end-run-switch function is also usable to guarantee that the wire will never be overstressed as the switch activation will signal the electronic circuit to cut the current flow in the wire preventing a to long application of the current leading to a out of specific temperature.
7) In a normal application the algorithm shall be made in such a way that anyway the application timing of the current still cannot go over a certain amount. This is necessary to overcome possible malfunctioning of the switch that will maintain indefinitely the application of the power to the wire.

FIG. 10 illustrates a practical embodiment of the device of the invention comprising a liquid container (2) having a pump spray head or valve (1) and a porous sleeve (3) located around said pump spray head (1). One end of a memory wire (11) is fixed to a point (8) joined to the casing (30) of the device, whereas the other end of the wire is connected to a point of the lever (5) which can pivot about an axis (32). The lever (5) is adapted to press down the spray head (1) when the wire (11) shrinks.

An electronic circuit (7) powered by a battery (13) feeds an electric current to the wire (11) to cause its shrinking.

An end-run switch (15) coupled to an end of the lever (5), is electrically connected (not visible in the figure) to the circuit (7) so that the electronic circuit (7) is configured in such a manner that when the switch (15) contacts a stopper element (29), the circuit cuts the circulation of current through the wire. The position of the stopper element (29) is adjustable in order to regulate the end point of the movement of the lever (5), thus selecting the pumping dosage of the pump by modifying the activation length of the pump.

In alternative embodiments of the invention, the device includes two or more pump containers and a wire for each of said containers, obtaining thereby a multifragrance device.

Alternatively, a single wire can the arranged to activate more than one pump container.

Obviously, the above-described embodiments can be combined within the spirit of the invention. While the invention has been disclosed in this patent application by reference to the details of the preferred embodiments of the invention, it is to be understood that the disclosure is intended in an illustrative rather than in a limiting sense, as it is contemplated that modifications will readily occur to those skilled in the art, within the spirit of the invention and the scope of the appended claims and their equivalents.

What is claimed is:

1. A spray pump device comprising a spray head and a wire provided to operate the spray head, wherein the wire is made of a memory shape metal alloy and is configured to shrink when a suitable electric current passes through the wire;

a lever pivotally mounted about an axis, a first end of the wire is joined to a point of the lever, and a second point of the wire is joined to a fixed point of the device, the lever is adapted to activate the spray head when the wire shrinks;

an electronic circuit to supply the electric current through the wire for shrinking the wire, the electronic circuit being fed by a battery; and an end-run-switch connected to the electronic circuit, the end-run-switch being arranged to detect a selected position in which the spray head has been activated, the electronic circuit being adapted to cut the electric current through the wire when the end-run-switch detects that the spray head has been activated.

2. The device according to claim 1, wherein the wire is arranged so as to exert a force that activates the spray head.

3. The device according to claim 1, further comprising a stopper element configured to provide a reference end position of the end-run switch, and wherein the position of the stopper element is adjustable to regulate the reference end position of the end-run switch.

4. The device according to claim 1, wherein the lever is pivotally mounted in respect to one of its ends.

5. The device according to claim 1, wherein the wire is arranged substantially parallel to the longitudinal axis of the spray head.

6. The device according to claim 1, further comprising a porous material arranged to receive a major amount of the liquid sprayed by the spray head.

7. The device according to claim 6, wherein the porous material extends around the spray head.

8. The device according to claim 6, wherein the spray head has an output nozzle which is closed by the porous material.

9. The device according to claim 1, further comprising a container coupled to the spray head for containing a liquid.

10. The device according to claim 1, further comprising an ambient temperature sensor associated with the electronic circuit, the electronic circuit being adapted to prevent the accidental activation of the pump when the temperature of the ambient is over the wire transition temperature.

11. The device according to claim 1, further comprising a sensor selected from the group comprising: movement sensor, light sensor, proximity sensor, wherein the sensor is associated to the electronic circuit, and the activation of the spray head is governed by the sensor.

12. The device according to claim 1, wherein the spray head is configured to operate below 1 Kg force.

* * * * *